US006720492B2

(12) United States Patent
Steinbuhler

(10) Patent No.: US 6,720,492 B2
(45) Date of Patent: Apr. 13, 2004

(54) PORTABLE KEYBOARD

(76) Inventor: David Steinbuhler, 901 North St., Titusville, PA (US) 16354

( * ) Notice: Subject to any disclaimer, the term of this patent is extended or adjusted under 35 U.S.C. 154(b) by 0 days.

(21) Appl. No.: 10/218,022

(22) Filed: Aug. 12, 2002

(65) Prior Publication Data

US 2003/0106412 A1 Jun. 12, 2003

Related U.S. Application Data

(60) Provisional application No. 60/311,677, filed on Aug. 10, 2001.

(51) Int. Cl.[7] ..... G10C 3/12

(52) U.S. Cl. ..... 84/423 R; 84/424; 84/425

(58) Field of Search ..... 84/423 R, 424, 84/425, 426, 427, 430, 432, 433, 434, 436, 442, 444, 450

(56) References Cited

U.S. PATENT DOCUMENTS 4,679,477 A * 7/1987 Monte ..... 84/719

* cited by examiner

*Primary Examiner*—Kimberly Lockett
(74) *Attorney, Agent, or Firm*—Reed Smith LLP

(57) ABSTRACT

An arrangement for facilitating the installation of an action in a piano body. The arrangement includes at least one adjusting medium being adapted to facilitate the positioning of the action with respect to a piano body, wherein the at least one adjusting medium is associated solely with the action.

32 Claims, 8 Drawing Sheets

PORTABLE KEYBOARD

This application claims the benefit of provisional application Ser. No. 60/311,677 filed Aug. 10, 2001.

FIELD OF THE INVENTION

The present invention generally relates to pianos and their associated keyboards.

BACKGROUND OF THE INVENTION

Normally, a keyboard for a grand piano includes a set of keys mounted on a frame, to which is mounted the piano's action stack. The action stack contains all the hammers that strike the piano's strings and produce the piano's sound. Taken together, the action stack and the piano's keyboard form a complete unit in a grand piano called the "action" or "piano's action" and, normally, this unit is easily removable from the piano.

With the advent of the acceptance of alternative size keyboards for the piano, it has become important for pianos to be able to accommodate two or more actions that can be interchanged. A problem arises, however, in that high quality grand pianos, for the most part, are hand made, which results in small differences from piano to piano in their internal dimensions. The keyboard for a specific piano is therefore hand-fit for that piano and will not necessarily fit into another piano of the same make and model.

Accordingly, a need has been recognized in connection with making grand piano's keyboard adjustable so that a new action for the piano can be made to fit into any piano of the same make and model.

SUMMARY OF THE INVENTION

In accordance with at least one presently preferred embodiment of the present invention, provisions are made for various adjustments that can easily be made by a technician, such that a new keyboard can quickly be installed into any piano of a given make and model without any time-consuming custom hand-fitting. This will potentially allow for the mass producing of new keyboards that can easily be fit into existing pianos. It also affords a concert artist the ability to perform on his/her own keyboard by having it easily installed into the piano at a given concert hall, such as one in another city when the pianist is on tour. The artist will then have the use of his/her keyboard that has the "touch" as well as the size of keys that he/she prefers without having to transport his/her entire piano.

Generally, there is broadly contemplated in accordance with at least one presently preferred embodiment of the present invention An arrangement for facilitating the installation of an action in a piano body, the arrangement comprising: at least one adjusting medium being adapted to facilitate the positioning of the action with respect to a piano body, the at least one adjusting medium being associated solely with the action.

Further, there is broadly contemplated in accordance with at least one presently preferred embodiment of the present invention a piano action comprising: an arrangement for facilitating the installation of the action in a piano body, the arrangement comprising at least one adjusting medium being adapted to facilitate the positioning of the action with respect to a piano body, the at least one adjusting medium being associated solely with the action.

BRIEF DESCRIPTION OF THE DRAWINGS

The present invention and its presently preferred embodiments will be better understood by way of reference to the detailed disclosure herebelow and to the accompanying drawings, wherein.

DESCRIPTION OF THE PREFERRED EMBODIMENTS

By way of general terminology, the action is a complete unit that includes a keyboard and an action stack. The keyboard is a set of keys mounted to a frame. The action stack, which holds all the hammers of the piano, is mounted to this key frame. Pressing a key in the action will actuate a hammer in the action. This unit normally is slid into a compartment inside the piano. Once installed in a piano, the action is normally free to move about ⅛ of an inch to the right by the use of the "soft pedal". (A soft pedal operates such that a hammer that will normally hit 3 strings can be made to play softer by sliding the action to the right where it will now hit only 2 strings.) This movement to the right is typically accomplished by a lever that fits into a slot in the bottom of the key frame. A spring mounted on the right side of the piano typically pushes on the right side of the key frame and pushes the action back to the left once the soft pedal is released. The action will then typically move to the left until the left side of the frame meets a stop in the left side of the piano. Glide pins mounted in the frame insert into fittings in the cheek blocks and these keep the action in position front to back.

In accordance with at least one presently preferred embodiment of the present invention, various adjustments can be made on or relative to a piano keyboard so that a new action can be installed into an existing piano and made to work properly without changing anything on the original piano. This will allow the new action and the original action to be interchangeable. Once the new keyboard has been adjusted, the original action and the new action can then be interchanged in a couple of minutes.

The adjustments on a new keyboard compensate for the variations in the internal dimensions that are found from piano to piano in a given make and model. These variations include, inter alia, the level of the key bed, the string height above the key bed, the height of the damper levers above the key bed, the location of the action soft pedal lever, and the overall width, depth, and height of the compartment in the piano that houses the piano's keyboard. Some adjustments contemplated in accordance with at least one embodiment of the present invention are discussed below, and particularly with reference to the accompanying drawings. Any and all such adjustment mechanisms may preferably be included with respect to an action (with keyboard).

Figure 1B:
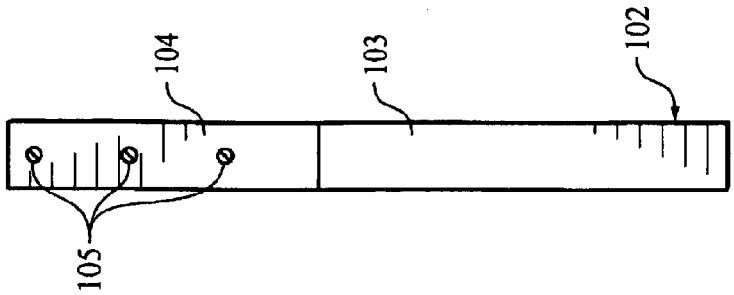
FIGS. 1*a* and 1*b* are top and left side views, respectively, of the left side of a keyboard frame.
Figure 1A:
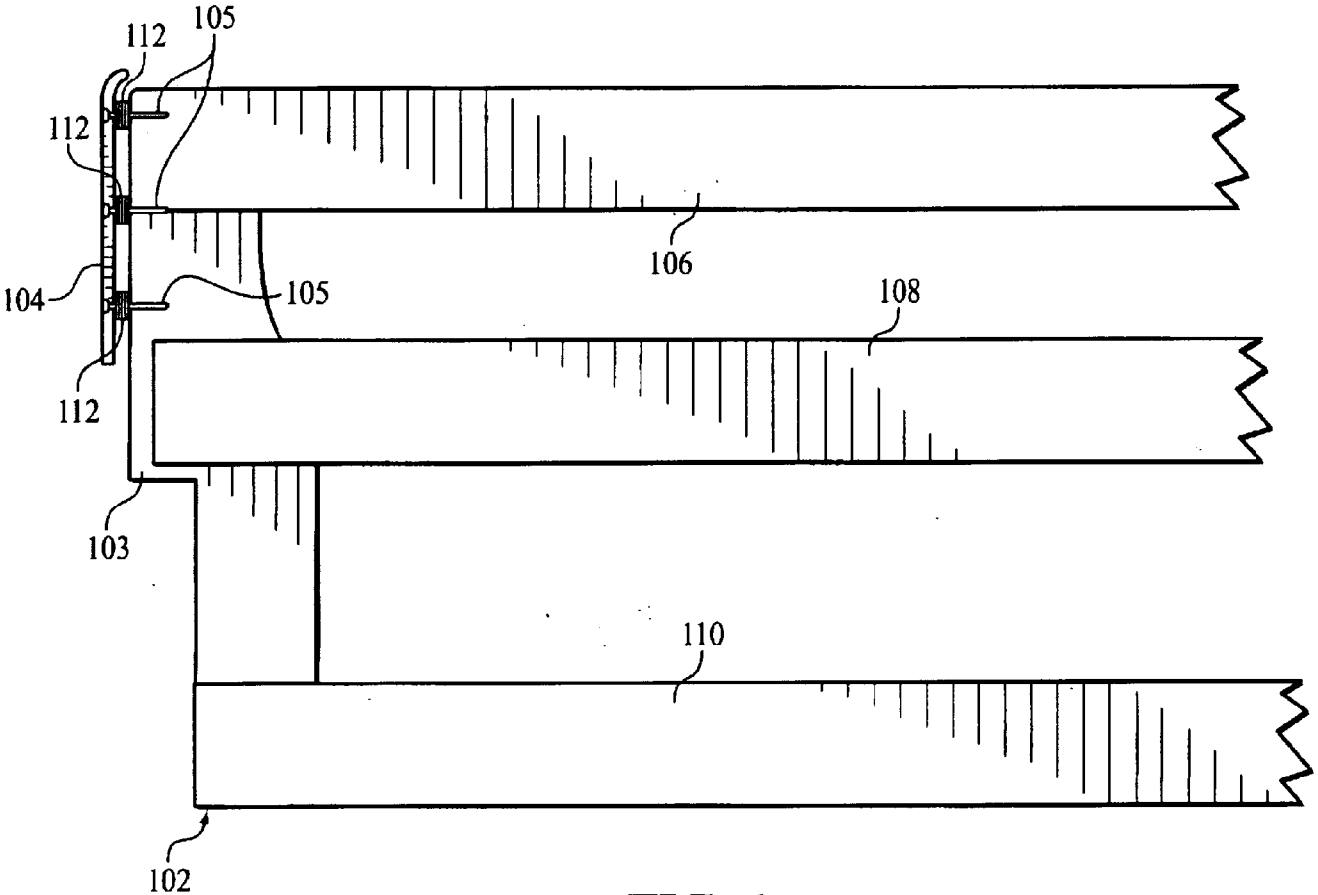

With reference to FIGS. 1*a* and 1*b* (top and left side views, respectively, of a keyboard frame 102 including slat 103, back rail 106, balance rail 108 and front rail 110), provision may be made for an adjustment on the left side of the frame of the keyboard so that the hammers on the action stack can be made to align accurately under the strings of the piano. As shown in FIG. 1*a*, there may be an adjustable piece provided at the left side of the keyboard frame 102, attached to a slat 103 via screws 105 he like. The adjustable piece 104 may be made out of metal or any other suitable material. By adjusting the screws or other adjusting elements 105, the adjustable piece 104 can be moved away from or towards the slat 103. It will be appreciated that the adjustable piece will ultimately bear up against a stop in a piano body when the frame is installed in a piano. A suitable number of spacers 112 may be provided about each screw (or other adjusting element) 105, and may fill the gap between the adjustable piece 104 and the slat 103.

Figure 2:
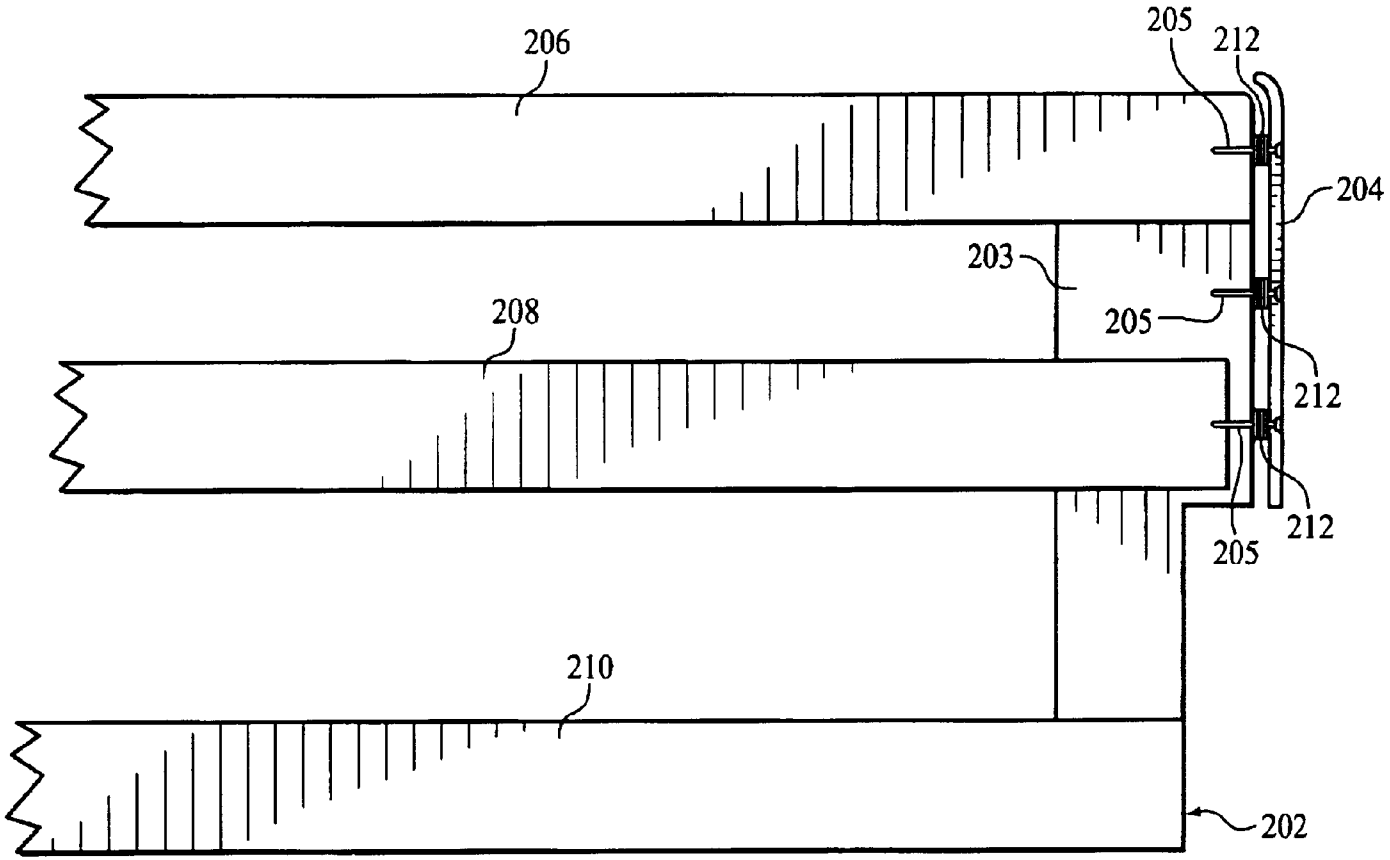
FIG. 2 is a top view of the right side of a keyboard frame.

As shown in FIG. 2 (a top view of a keyboard frame 202 including slat 203, back rail 206, balance rail 208 and front rail 210), provision may be made for an adjustment on the right side of the frame of the keyboard so that an action return spring can be made to operate at its proper strength. As shown, an adjustable piece 204, which may be substantially similar in general makeup to the one shown at 104 in FIG. 1*a*, may be provided. Again, the adjustable piece 204 may be attached to slat 203 via screws or the like (205) and may be made out of metal or any other suitable material. Again, by adjusting the screws or other adjusting elements (205), the adjustable piece 204 can be moved away from or towards the slat 203. In this case, it will be appreciated that the adjustable piece 204 will ultimately bear up against a spring typically found in the right-hand side of many pianos (particularly, that spring which biases the keyboard frame [or "keyframe"] to the left and, thus, towards the aforementioned stop typically found at the left-hand side of many pianos). Again, a suitable number of spacers 212 may be provided about each screw (or other adjusting element) 205, and may fill the gap between the adjustable piece 204 and the slat 203.

Figure 3A:
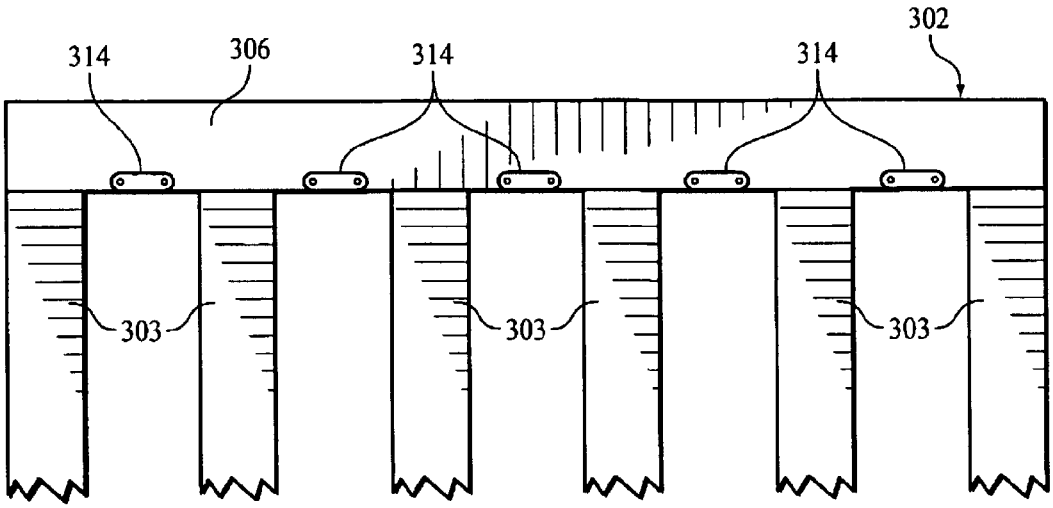
FIG. 3*a* is a bottom view of the rear of a keyboard frame.

FIG. 3*a* is a bottom view of a keyboard frame 302 (with an entire back rail 306 intersecting with a number of spaced-apart slats 303) showing five adjustable blocks 314 in accordance with an embodiment of the present invention. The blocks 314 may be provided in back rail 306 to allow for the adjustment of the overall height of the action stack. This can compensate for variations in string height without having to regulate the action. The blocks 314 can also be used to "bed" the back rail to the bed of the piano.

Figure 3B:
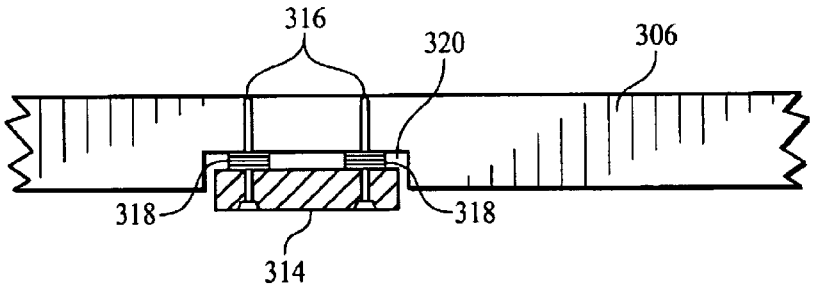
FIG. 3*b* is a close-up frontal view, and FIG. 3*c* a close-up bottom view, of an adjustable block and associated components.
Figure 3C:
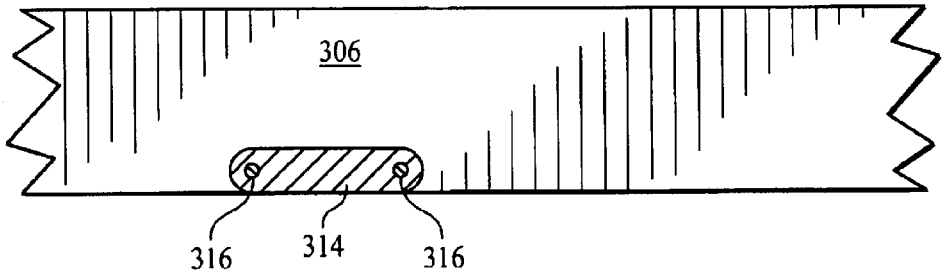

FIG. 3*b* is a close-up frontal view, and FIG. 3*c* a close-up bottom view, of one of the adjustable blocks 314 and associated components. As shown, the adjustable block 314 may be attached via screws or the like 316 to the back rail 306. Spacers 318 may be provided about each screw (or other adjusting element) 316 to essentially fill the gap between the adjustable block 314 and the back rail 306. (As shown, each adjustable block may essentially reside in a recess 320 provided within the back rail.) It will be appreciated that adjustable blocks 314 such as those shown in FIGS. 3*a*–3*c* can provide a fine height adjustment at the back rail 306 that hitherto might not have been possible.

Figure 4A:
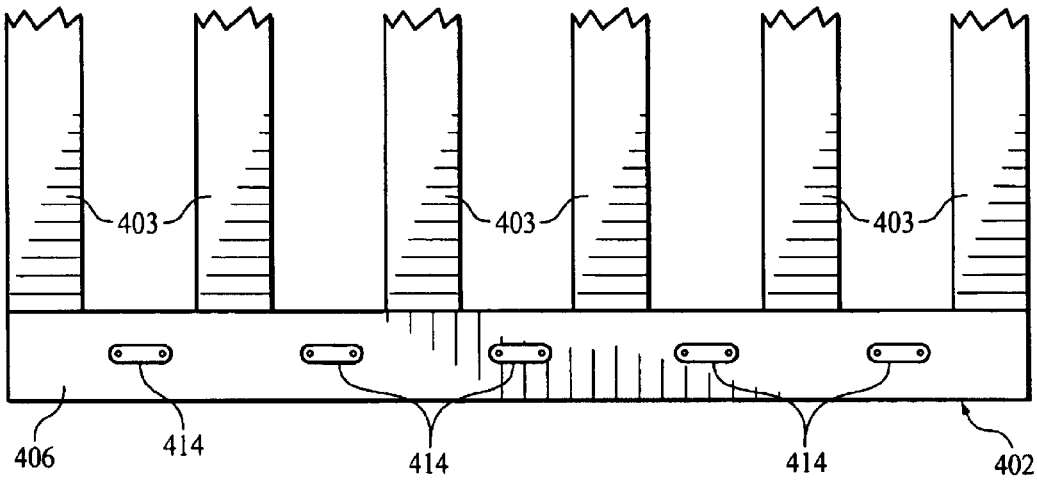
FIG. 4*a* is a bottom view of the front of a keyboard frame.

Similarly, as shown in FIG. 4*a* (a bottom view of a keyboard frame 402 with slats 403, but at the front), adjustable blocks 414 may be provided in the front rail 410 of the frame 402 to allow for the adjustment of the overall height of the front of the keys. This compensates for variations in the height of the fallboard without having to regulate the height of the keys. The blocks can also be used to "bed" the front rail to the bed of the piano.

Figure 4B:
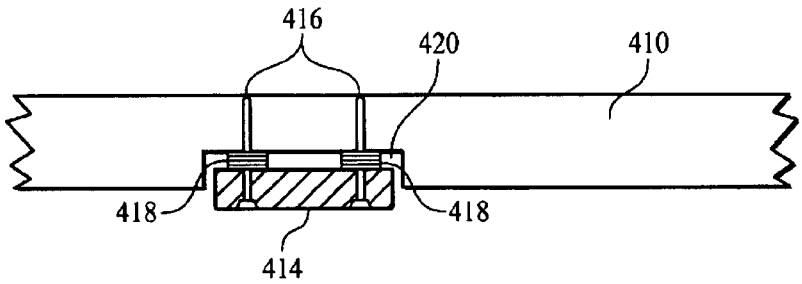
FIG. 4*b* is a close-up frontal view, and FIG. 4*c* a close-up bottom view, of an adjustable block and associated components.
Figure 4C:
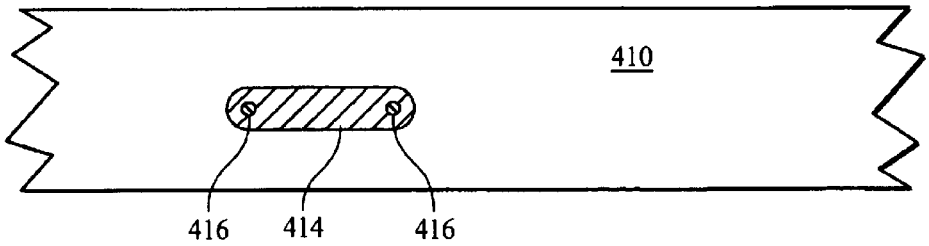

FIG. 4*b* is a close-up cut-away elevational view, and FIG. 4*c* a close-up bottom view, of one of the adjustable blocks 414 and associated components. Similarly to the adjustable blocks 314 described and illustrated with respect to FIGS. 3*a*–3*c*, here an adjustable block 414 may be attached via screws or the like (416) to the front rail 410. Again, spacers 418 may be provided about each screw (or other adjusting element) 416 to essentially fill the gap between the adjustable block 414 and the front rail 410. (As shown, each adjustable block 414 may essentially reside in a recess 420 provided within the front rail 410.) It will be appreciated that adjustable blocks 414 such as those shown in FIGS. 4*a*–4*c* can provide a fine height adjustment at the front rail 410 that hitherto might not have been possible.

Figure 5A:
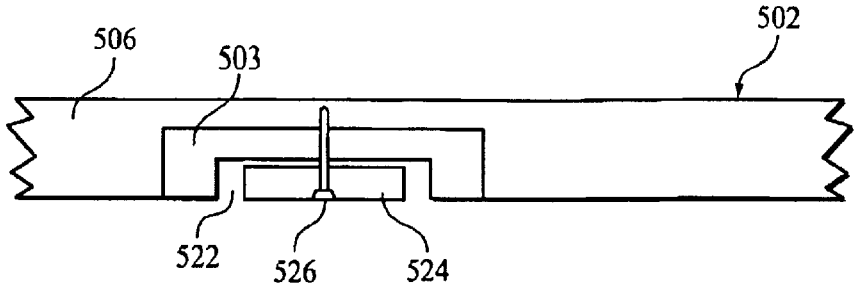
FIGS. 5*a* and 5*b* are a front view and bottom view, respectively, of a keyboard frame back rail and attached slat.
Figure 5B:
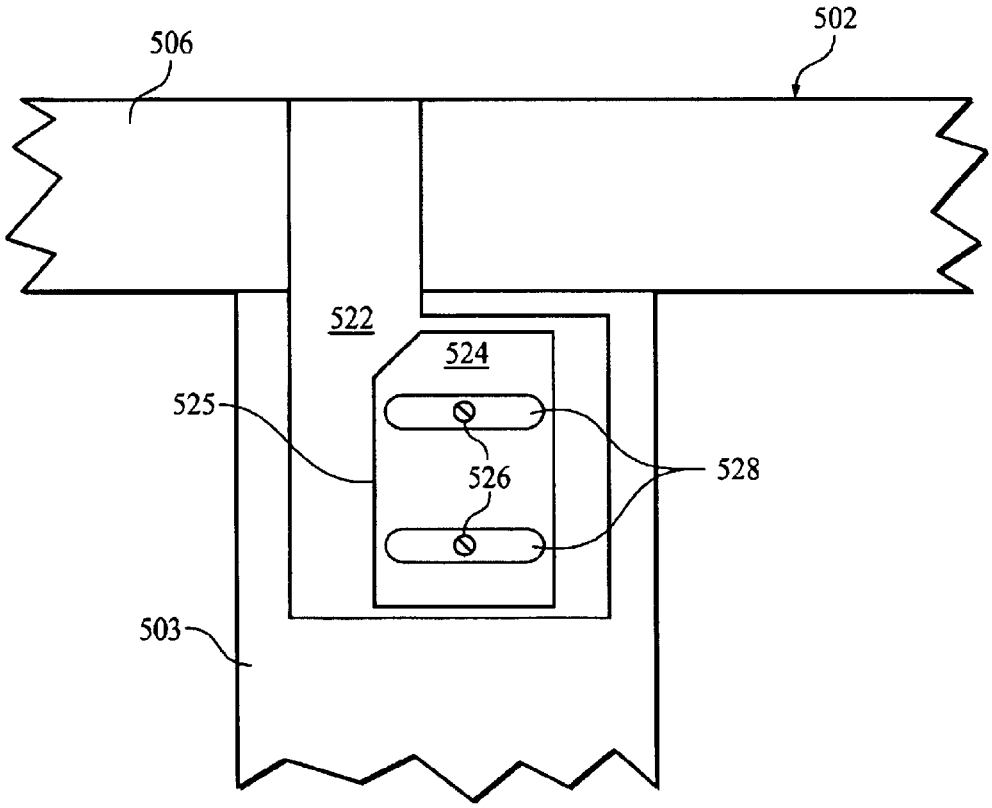

As shown in FIGS. 5*a* and 5*b* (a front view and bottom view, respectively, of a back rail 506 and attached slat 503 in a keyboard frame 502), a provision may be made for an adjustment, in the configuration of the slot 522 normally used by the soft pedal to shift the action. Particularly, as shown in FIGS. 5*a* and 5*b*, an adjustable block 524 may be movable from left to right in order to adjust the position of the surface 525 against which a lever from the "soft pedal" pushes in order to shift the entire action. In this way, it will not be necessary to adjust the soft pedal lever mechanism itself, as has normally been the case. Thus, in keeping with the other types of adjustment mechanisms described and contemplated herein, adjustments are made only on the keyboard structure and not on the piano structure. As shown, two screws 526 may be provided within elongated slots 528 to permit the aforementioned left-to-right adjustment.

In connection with considerations relating to the soft pedal, it is normally the case that the action, when shifted by the soft pedal and associated lever mechanism, ultimately hits upon a screw or other type of adjustable stop located on the piano structure. However, in keeping with the other types of adjustment mechanisms described and contemplated herein, such a screw or stop may instead be placed on the keyboard structure and not on the piano structure.

Figure 6:
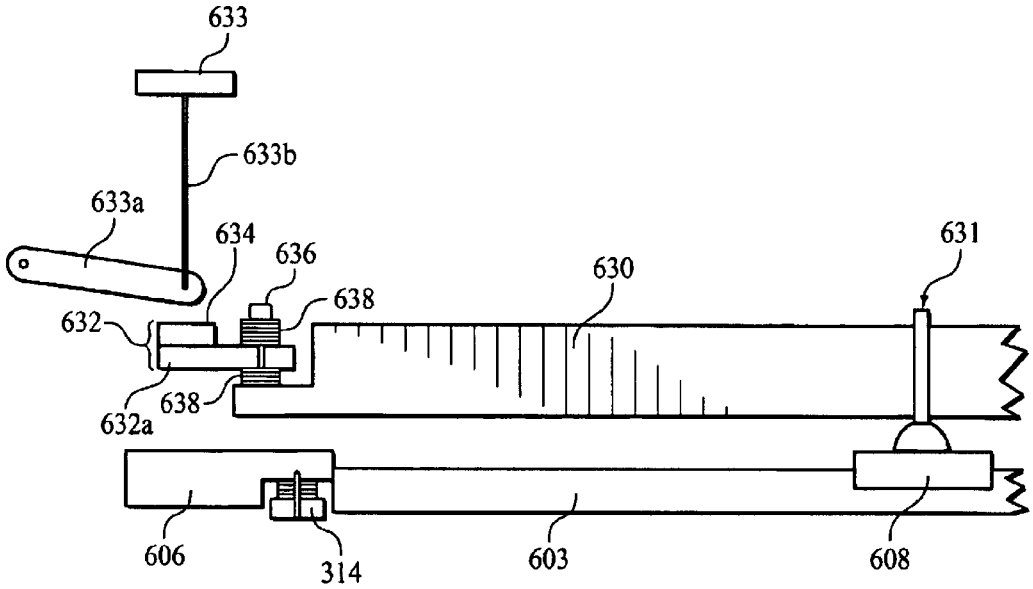
FIG. 6 is a side view of a piano key and associated components.

FIG. 6 (a side view of a piano key 630 and associated components, as well as back rail 606, balance rail 608 and balance mechanism 631) illustrates a component 632 which may be termed a "damper lifter". As shown, the damper lifter 632 may be mounted on the back of key 630, and damper lifter felt 634 may be mounted as part of the damper lifter 632. (Preferably, damper lifter 632 will be so positioned and configured as to strike a lever 633*a* which moves a rod 633*b* to lift a string damper 633, all when key 630 is played.) The damper lifter 632 is preferably adjustable and compensates for variations in the height of the back rail 606 (e.g., in accordance with the embodiment illustrated in FIGS. 3*a*–3*c*). Also, damper lifters 632 of differing length may preferably compensate for differences in the depth of the action compartment in the piano.

Essentially, since the height of the back rail 606 may be adjustable in accordance with an embodiment of the present invention (e.g., via an adjustable block 314; see FIGS. 3*a*–3*c* and related discussion), the vertical position of the damper lifter 632 may preferably be adjustable to compensate for variation in the height of the back rail 606 and also for possible variation in height in the lever 633*a*. In accordance with an embodiment of the present invention, the damper lifter 632 is a removable part that includes a small board or slat 632*a* to which conventional felt 634 may be attached. As shown, the small board or slat 632*a* may be attached via a screw 636 to the piano key 630, and spacers (e.g. metal spacers) 638 are preferably provided about the screw 636 both between the board/slat 632*a* and screw head and between the board/slat 632*a* and the main body of the piano key 630. It should be understood that pivoting adjustment of the damper lifter 632 is also possible, by pivoting the same about screw 636 to a desired position and then fixing it in place.

Preferably, any damper lifter will be interchangeable with a damper lifter of different length. In this manner, the length of a damper lifter can be customized to compensate for variations in the depth of an action compartment in different pianos.

Figure 7A:
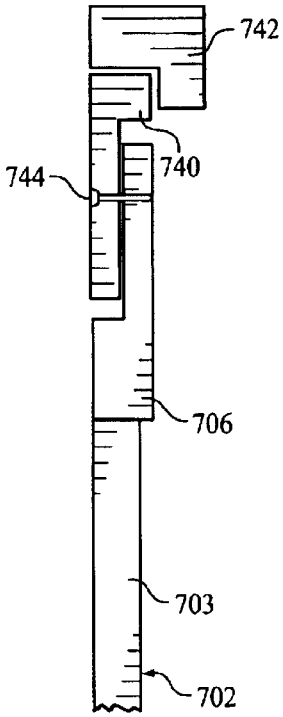
FIGS. 7*a* and 7*b* are a side view and top view, respectively, of a back rail of a keyboard frame.
Figure 7B:
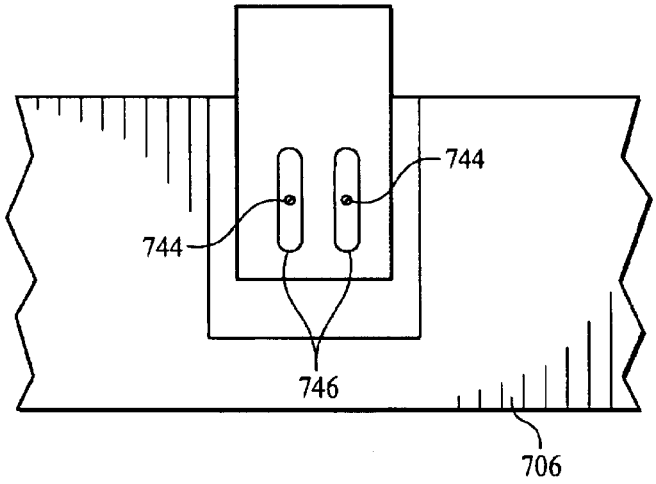

As shown in FIGS. 7*a* and 7*b* (a side view and top view, respectively, of a back rail 706 of a keyboard frame 702 as well as a slat 703 intersecting back rail 706), a provision may be made for an adjustable block 740 in the back of the frame that will fit under the "dag blocks" 742 that are used to hold the action to the bed of the piano during transportation of the piano when the piano is placed on its side. Normally, the back rail 706 fits under the dag blocks 742 but here, the back rail 706 is made narrower and the new adjustable block 740 is made to fit under the dag block. This will compensate for differences in the location of the dag blocks 742. As shown, the adjustable block 740 may be attached via screws 744 to the back rail 706. The screws 744 themselves may be disposed in elongated slots 746 in the adjustable block 740 to allow for back-to-front adjustment of the adjustable block 740.

Thus, in accordance with a presently preferred embodiment of the present invention, the back rail 706 of a keyboard frame is accordingly made narrower and an adjustable block 740, such as that shown in FIGS. 7*a* and 7*b*, is attached to it. The adjustable block 740 is intended to be disposed under a dag block 742.

Figure 8A:
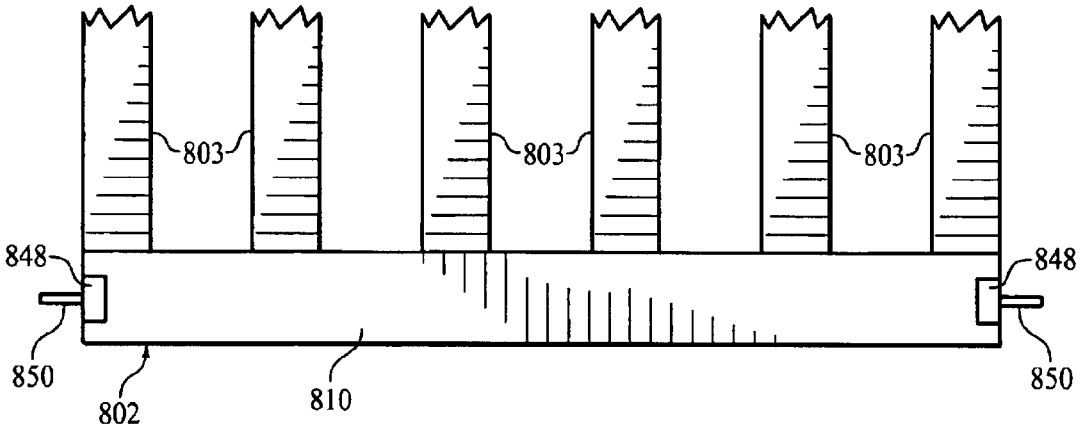
FIGS. 8*a* and 8*b* are top and closeup views, respectively, of the front rail of a keyboard frame and other components.
Figure 8B:
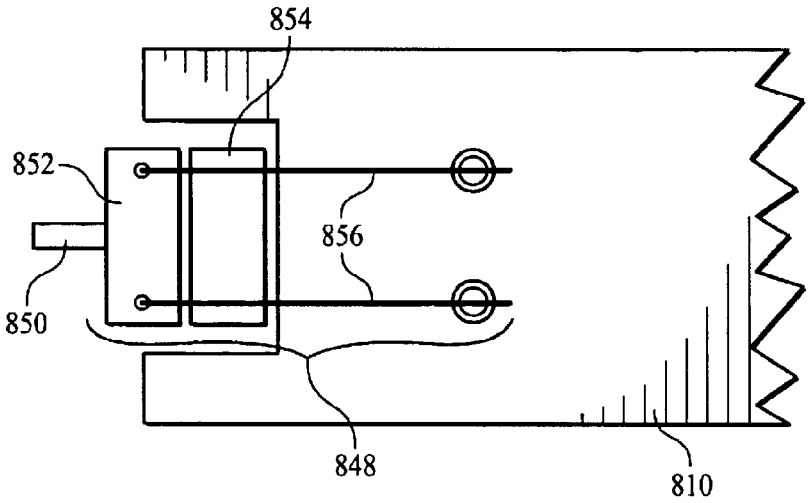

FIGS. 8*a* and 8*b* are top and closeup views, respectively, of the front rail 810 of a keyboard frame 802 (with intersecting slats 803) and other components. As shown, an adjustment arrangement 848 is provided for the adjustment of the location of glide pins 850 that normally fit into cheek blocks and establish the position of a keyboard front-to-back. This adjustment arrangement 848 will compensate for differences in the location of the fittings in the cheek blocks (not shown here).

As shown, adjustment arrangement 848 may preferably include an adjustment block 852 which supports glide pin 850, a spacer 854 (though more could conceivably be provided) and screws 856 which attach block 852 and spacer(s) 854 to front rail 810. Normally, glide pins serve to allow the keyboard to move side-to-side, via the soft pedal, by about ⅛ inch while helping to establish the front-to-back position of the keyboard frame through insertion into the aforementioned cheek blocks.

Figure 9:
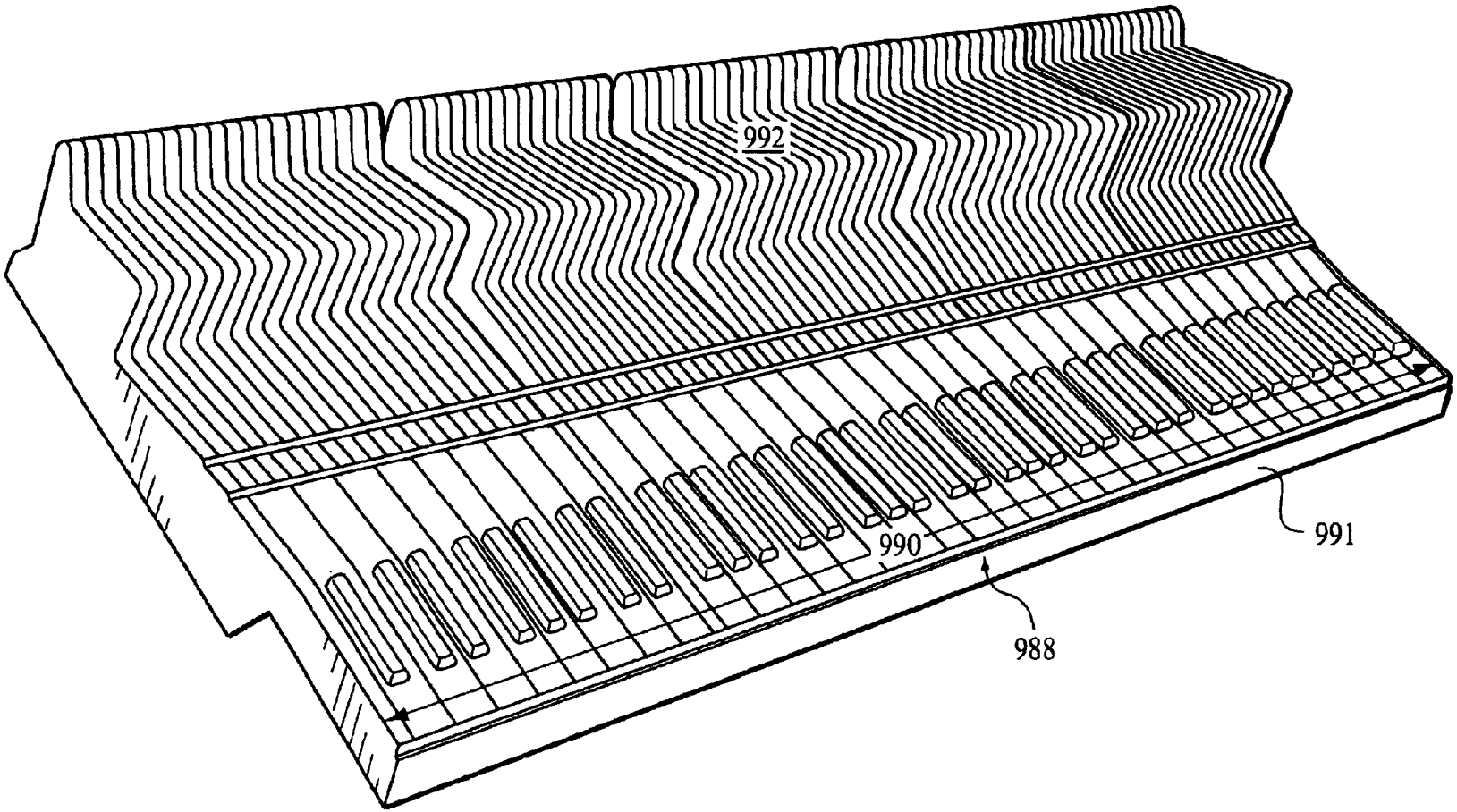
FIG. 9 is a general perspective view of a piano action.

For general reference herein, FIG. 9 is a general perspective view of a piano action 988. Shown are piano keys 990 mounted on a frame 991, to which is mounted the piano's action stack 992.

It should be understood that various embodiments of the present invention may be employed in different types of settings relating to pianos. Though the realm of hand-crafted concert grand pianos is recognized as an appropriate context for one or more embodiments of the present invention, it should be understood that a wide range of types of grand pianos and baby grand pianos, with full-sized or reduced-size keyboards, may appropriately employ one or more of the embodiments of the present invention. (General background information on reduced-size keyboards may be found in U.S. Pat. No. 5,847,301 to Steinbuhler.)

If not otherwise stated herein, it may be assumed that all components and/or processes described heretofore may, if appropriate, be considered to be interchangeable with similar components and/or processes disclosed elsewhere in the specification, unless an express indication is made to the contrary.

If not otherwise stated herein, any and all patents, patent publications, articles and other printed publications discussed or mentioned herein are hereby incorporated by reference as if set forth in their entirety herein.

It should be appreciated that the apparatus and method of the present invention may be configured and conducted as appropriate for any context at hand. The embodiments described above are to be considered in all respects only as illustrative and not restrictive. All changes which come within the meaning and range of equivalency of the claims are to be embraced within their scope.

What is claimed is:

1. An arrangement for facilitating the installation of an action in a piano body, the action comprising an action stack, a keyboard and a keyboard frame, said arrangement comprising:

at least one adjusting medium being adapted to facilitate the positioning of the action with respect to a piano body, said at least one adjusting medium being associated solely with the action;

said at least one adjusting medium comprising at least one of: means for establishing a lateral position of the keyboard frame; means for adjusting the height of the keyboard frame; means for altering the configuration of a slot for accommodating a pedal component; means for altering the position of relative contact between the keyboard frame and at least one dag block; means for adjusting the strike position of a piano key with respect to a damper lever; and means for establishing a stop associated with pedal-actuated shifting of the keyboard frame.

2. The arrangement according to claim 1, wherein the piano body is a grand piano body.

3. The arrangement according to claim 1, wherein the keyboard is a reduced-size keyboard.

4. The arrangement according to claim 1, wherein said at least one adjusting mechanism comprises said means for establishing a lateral position of the keyboard frame.

5. The arrangement according to claim 4, wherein said means for establishing a lateral position comprises at least one adjustable element extending from at least one side of the keyboard frame and being positionally adjustable towards and away from the keyboard frame.

6. The arrangement according to claim 5, wherein one said adjustable element is attached to the left side of the keyboard frame.

7. The arrangement according to claim 5, wherein said one adjustable element is adapted to abut a stop on the piano body.

8. The arrangement according to claim 5, wherein one said adjustable element is attached to the right side of the keyboard frame.

9. The arrangement according to claim 5, wherein said one adjustable element is adapted to abut a spring for biasing the keyboard frame.

10. The arrangement according to claim 1, wherein said at least one adjusting mechanism comprises said means for adjusting the height of the keyboard frame.

11. The arrangement according to claim 10, wherein said means for adjusting height comprises at least one adjustable element disposed at the rear of the keyboard frame.

12. The arrangement according to claim 11, wherein the action comprises a keyboard frame, said at least one adjustment mechanism comprising means for adjusting the strike position of a piano key with respect to a damper lever.

13. The arrangement according to claim 12, wherein said means for adjusting the strike position comprises a damper lifter, said damper lifter being positionally adjustable towards and away from the piano key.

14. The arrangement according to claim 11, wherein said at least one adjustable element is attached to the back rail of the keyboard frame.

15. The arrangement according to claim 10, wherein said means for adjusting height comprises at least one adjustable element disposed at the front of the keyboard frame.

16. The arrangement according to claim 11, wherein said at least one adjustable element is attached to the front rail of the keyboard frame.

17. The arrangement according to claim 11, wherein said means for adjusting height comprises a plurality of adjustable elements disposed along at least a portion of the keyboard frame.

18. The arrangement according to claim 17, wherein said adjustable elements are disposed substantially evenly along a longitudinal dimension of the keyboard frame at at least one of the front and rear of the keyboard frame.

19. The arrangement according to claim 11, wherein said means for adjusting height comprises at least one adjustable block being positionally adjustable towards and away from the keyboard frame.

20. The arrangement according to claim 1, wherein said at least one adjusting mechanism comprises said means for altering the configuration of a slot accommodating a pedal component.

21. The arrangement according to claim 20, wherein the keyboard frame comprises a slot for accommodating a pedal component, said means for altering the configuration of a slot comprising means for altering the configuration of said slot.

22. The arrangement according to claim 21, wherein said means for altering the configuration of the slot comprises an adjustable block including a contact surface for contacting the pedal component.

23. The arrangement according to claim 22, wherein said adjustable block is mounted for lateral adjustment to selectively narrow or widen the slot.

24. The arrangement according to claim 21, wherein the pedal component is a soft pedal lever.

25. The arrangement according to claim 1, wherein said at least one adjusting mechanism comprises said means for adjusting the strike position of a piano key with respect to a damper lever.

26. The arrangement according to claim 25, wherein said means for adjusting the strike position comprises a damper lifter, said damper lifter being positionally adjustable towards and away from the piano key.

27. The arrangement according to claim 1, wherein said at least one adjusting mechanism comprises said means for altering the position of relative contact between the keyboard frame and at least one dag block.

28. The arrangement according to claim 27, wherein said means for altering the position of relative contact comprises an adjustment block mounted for back-and-forth adjustment to selectively extend or retract the position of relative contact between the keyboard frame and at least one dag block.

29. The arrangement according to claim 28, wherein said means for altering the position of relative contact is mounted at the rear of the keyboard frame.

30. The arrangement according to claim 1, the keyboard further comprising at least one glide pin, said arrangement further comprising an arrangement for laterally adjusting the at least one guide pin with respect to a cheek block in the piano body.

31. The arrangement according to claim 1, wherein said at least one adjusting mechanism comprises said means for establishing a stop associated with pedal-actuated shifting of the keyboard frame.

32. A piano action comprising:

an action stack;

a keyboard;

a keyboard frame; and an arrangement for facilitating the installation of said action in a piano body, said arrangement comprising at least one adjusting medium being adapted to facilitate the positioning of the action with respect to a piano body, said at least one adjusting medium being associated solely with said action;

said at least one adjusting medium comprising at least one of: means for establishing a lateral position of said keyboard frame; means for adjusting the height of said keyboard frame; means for altering the configuration of a slot for accommodating a pedal component; means for altering the position of relative contact between said keyboard frame and at least one dag block; means for adjusting the strike position of a piano key with respect to a damper lever; and means for establishing a stop associated with pedal-actuated shifting of said keyboard frame.

* * * * *